US007857298B2

(12) United States Patent
Schlough et al.

(10) Patent No.: US 7,857,298 B2
(45) Date of Patent: Dec. 28, 2010

(54) STITCHER DRIVE

(75) Inventors: James Richard Schlough, Stratham, NH (US); Kyle Sandahl, Dover, NH (US); Heiner Luxem, Durham, NH (US); Glenn Alan Guaraldi, Kingston, NH (US)

(73) Assignee: Goss International Americas, Inc., Dover, NH (US)

( * ) Notice: Subject to any disclaimer, the term of this patent is extended or adjusted under 35 U.S.C. 154(b) by 539 days.

(21) Appl. No.: 11/894,469

(22) Filed: Aug. 20, 2007

(65) Prior Publication Data

US 2008/0042337 A1 Feb. 21, 2008

Related U.S. Application Data

(60) Provisional application No. 60/838,635, filed on Aug. 18, 2006.

(51) Int. Cl.
*B65H 37/04* (2006.01)

(52) U.S. Cl. ..... 270/52.18; 270/52.26; 270/58.08

(58) Field of Classification Search ..... 270/52.16, 270/52.18, 52.26, 52.29, 58.08
See application file for complete search history.

(56) References Cited

U.S. PATENT DOCUMENTS

| | | | | |
|---|---|---|---|---|
| 3,601,388 | A | 8/1971 | Hilliard | |
| 4,196,835 | A | 4/1980 | Schlough | |
| 4,614,290 | A | 9/1986 | Boss | |
| 4,986,864 | A | 1/1991 | Heim et al. | |
| 5,772,195 | A * | 6/1998 | Mueller | 270/52.16 |
| 6,866,257 | B2 | 3/2005 | Brünner etal. | |
| 7,404,550 | B2 * | 7/2008 | Vogel et al. | 270/52.18 |
| 7,637,489 | B2 * | 12/2009 | Brunner et al. | 270/52.18 |
| 2002/0034410 | A1 | 3/2002 | Bartolome et al. | |
| 2005/0206062 | A1 | 9/2005 | Kuechler et al. | |
| 2005/0285319 | A1 | 12/2005 | Lee | |
| 2006/0043663 | A1 | 3/2006 | Vogel et al. | |
| 2007/0069443 | A1 * | 3/2007 | Brunner et al. | 270/52.18 |
| 2008/0036133 | A1 * | 2/2008 | Guaraldi et al. | 270/52.18 |

* cited by examiner

*Primary Examiner*—Leslie A Nicholson, III
(74) *Attorney, Agent, or Firm*—Davidson, Davidson & Kappel, LLC

(57) ABSTRACT

A stitcher is provided including a carriage having a center of gravity, the carriage movable between an extended position and a retracted position; at least one bearing for supporting the carriage; and an operating link for driving the carriage, a driving force of the link being applied through the center of gravity or between the center of gravity and the bearing. Another stitcher also is provided including a movable carriage having a center of gravity, the carriage movable between an extended position and a retracted position; and an operating link for driving the carriage, a driving force of the link being applied through the center of gravity when the carriage is in the extended or retracted position. A saddle stitcher is also provided. Methods for stitching are also provided.

11 Claims, 7 Drawing Sheets

STITCHER DRIVE

This claims the benefit of U.S. Provisional Application No. 60/838,635 filed Aug. 18, 2006, and hereby incorporated by reference herein.

BACKGROUND

Gathering machines such as saddle stitchers are known. In a saddle stitcher, a plurality of signatures delivered from sheet material feeders or hoppers are collected on a saddle-back conveyor. A stitcher stitches the collected signatures.

A saddle stitcher, for example, may collate signatures to assemble complete sets of signatures and bind them together using stitches. The signatures are opened to the center fold and collated by feeders onto a saddle chain to be conveyed past a stitching mechanism. These bound signatures, or books, are then removed from the saddle conveyor for further processing, such as trimming the unbound edges.

U.S. Pat. No. 4,196,835 purportedly discloses a collating machine that includes a stitcher assembly which stitches a group of signatures while they are moving. The stitching assembly does not require the use of rails for guiding any reciprocating mechanisms.

U.S. Pat. No. 6,866,257 purportedly discloses a gathering-stitching machine having a guide element in the stitching region, wherein a run of folded sheets or signatures in the stitching region is improved, and downtime resulting from disruptions in the inlet and outlet of the stitching region is shortened.

U.S. Publication No. 2005/0285319 discloses a stitcher and a conveyor for moving unbound printed products past the stitcher for stitching. The conveyor includes a timing belt having a plurality of pushing elements for engaging and moving the unbound printed products past the stitcher.

SUMMARY OF THE INVENTION

In accordance with an embodiment of the present invention, a stitcher includes a carriage having a center of gravity. The carriage is movable between an extended position and a retracted position. At least one bearing is provided for supporting the carriage. An operating link is provided for driving the carriage. A driving force of the link is applied through the center of gravity or between the center of gravity and the bearing.

In accordance with another embodiment of the present invention, a stitcher includes a movable carriage having a center of gravity. The carriage is movable between an extended position and a retracted position. An operating link is provided for driving the carriage. A driving force of the link is applied through the center of gravity when the carriage is in the extended or retracted position.

In accordance with a further embodiment of the present invention, a saddle stitcher includes a plurality of hoppers. A conveyor is provided collecting sheet material from the plurality of hoppers. A stitcher is provided. The stitcher includes a carriage having a center of gravity. The carriage is movable between an extended position and a retracted position. At least one bearing is provided for supporting the carriage. An operating link is provided for driving the carriage. A driving force of the link is applied through the center of gravity or between the center of gravity and the bearing.

In accordance with an embodiment of the present invention, a method of stitching sheet material includes applying a driving force to a stitcher through the center of gravity or between the center of gravity and a bearing and stitching sheet material.

In accordance with another embodiment of the present invention, a method of stitching sheet material includes applying a driving force to a stitching carriage, moving the stitching carriage between a retracted position and an extended position and back to a retracted position to complete a stitching cycle and stitching sheet material during the stitching cycle. The driving force is applied through a center of gravity of the stitching carriage during at least one point in the stitching cycle.

BRIEF DESCRIPTION OF THE DRAWINGS

A preferred embodiment of the present invention will be elucidated with reference to the drawings, in which.

DETAILED DESCRIPTION OF THE PREFERRED EMBODIMENTS

Figure 1:
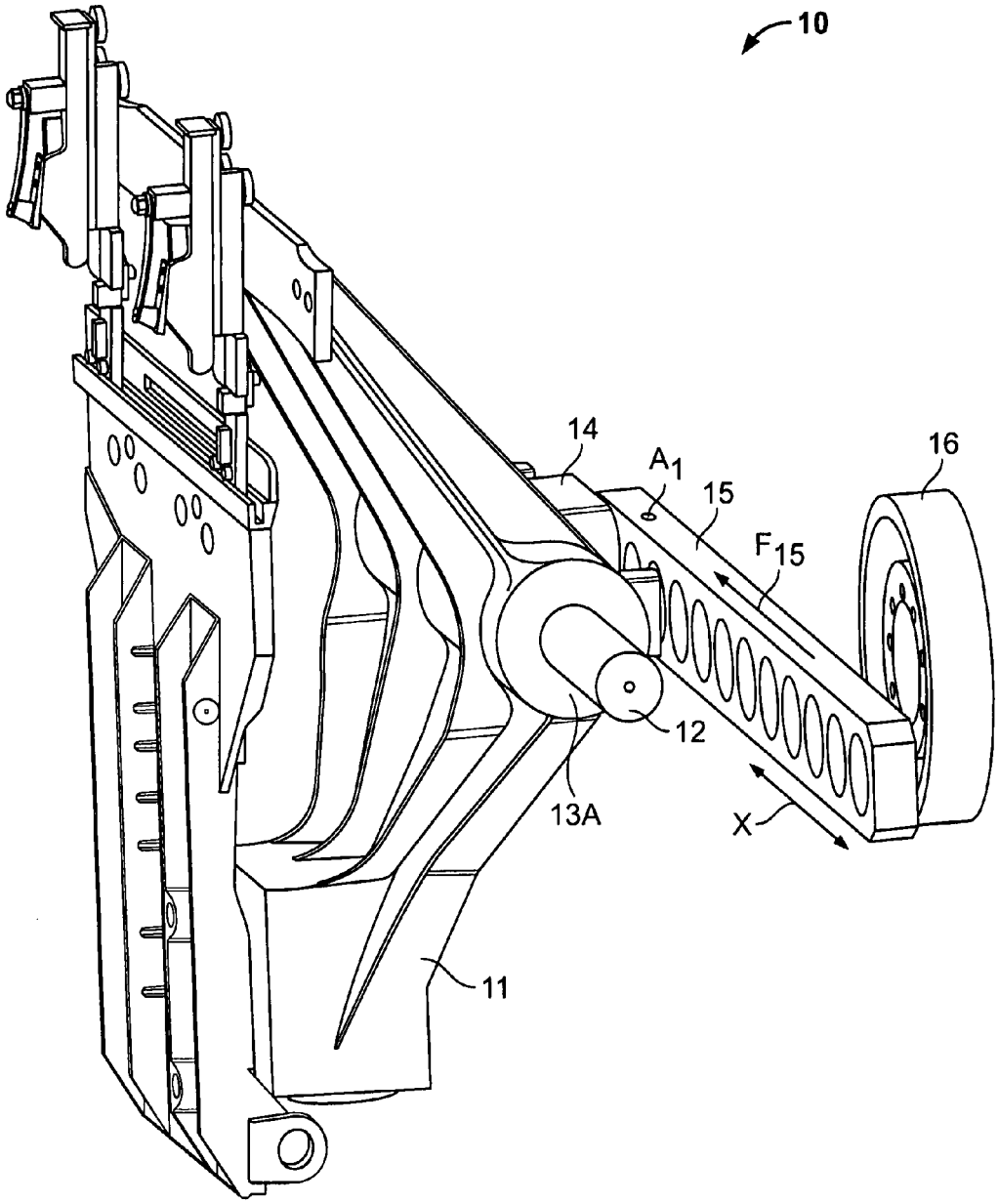
FIG. 1 (Prior Art)
FIGS. 1 and 2 show a prior art stitcher.
Figure 2:
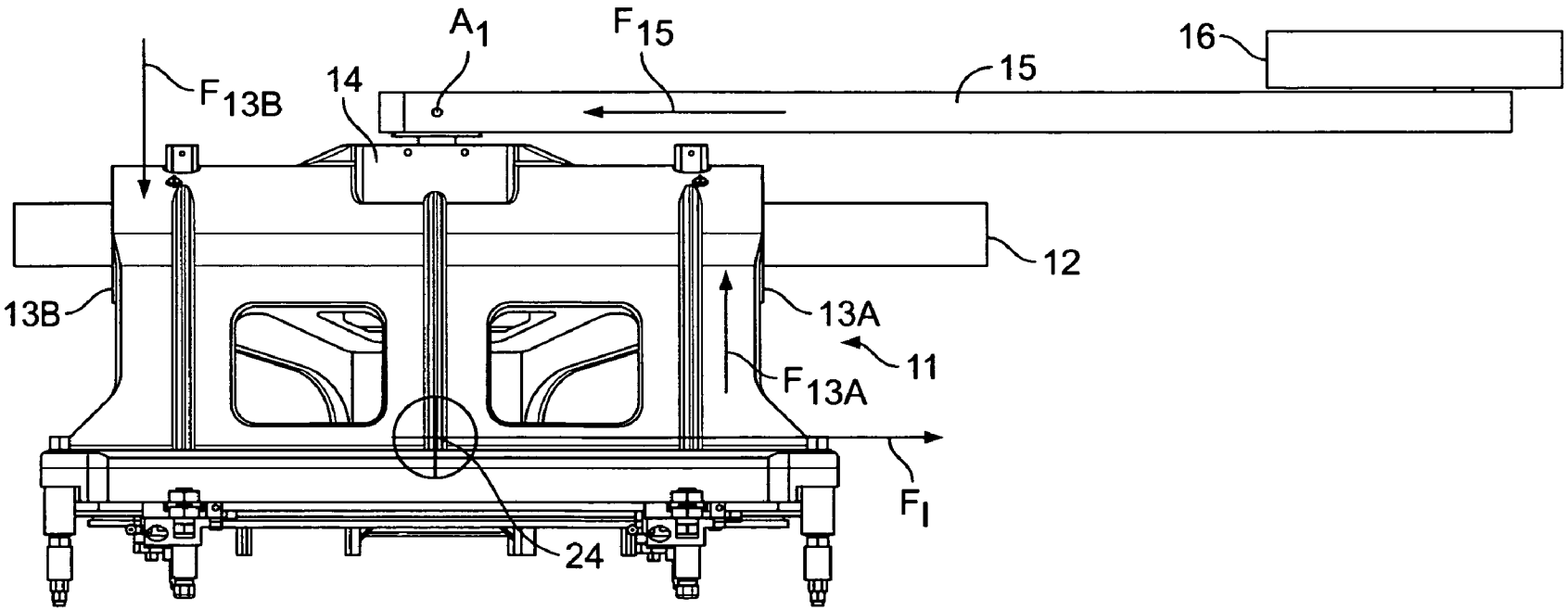
FIG. 2 (Prior Art)

FIGS. 1 and 2 show a prior art stitcher 10. A carriage 11 is supported by ball bushings 13A, 13B which slide on shaft 12. Carriage 11 oscillates back and forth via crank 16 and operating link 15. As crank 16 rotates, operating link 15 moves back and forth in a direction X. Operating link 15 is connected to carriage 11 by bearing block 14. Operating link 15 applies a force $F_{15}$ at a point $A_1$ which is transferred to carriage 11.

FIG. 2 shows carriage 11 in a furthest upstream position. In this upstream position, carriage 11 has a zero velocity but is under maximum acceleration due to actions of crank 16 and operating link 15. The force $F_{15}$ of operating link 15 on carriage 11 produces an inertial force $F_1$. Inertial force $F_1$ is equal and opposite to link force $F_{15}$. A moment develops due to the displacement between the force $F_{15}$ of operating link 15 applied at point $A_1$ and a center of gravity 24 of carriage 11. The resulting moment is supported by forces $F_{13A}$, $F_{13B}$ in ball bushings 13A, 13B respectively. As shown in FIGS. 1 and 2 the location of operating link 15 is such that force $F_{15}$ is applied further from center of gravity 24 then ball bushings 13A, 13B. Inertial force $F_1$ is very high, which results in very high forces $F_{13A}$, $F_{13B}$ in ball bushings 13A, 13B.

Figure 3A:
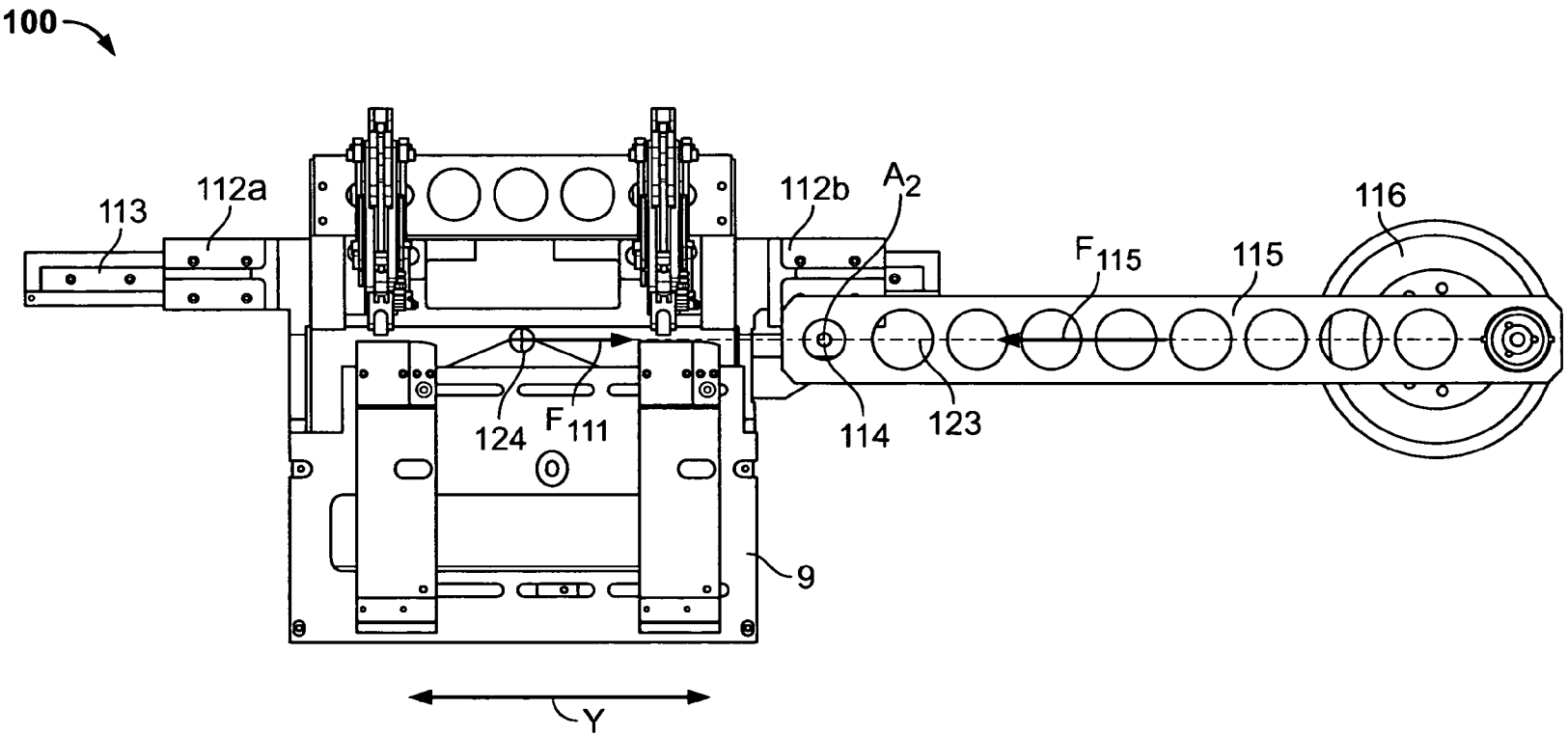
FIGS. 3A and 3B show a stitcher according to the present invention.
Figure 3B:
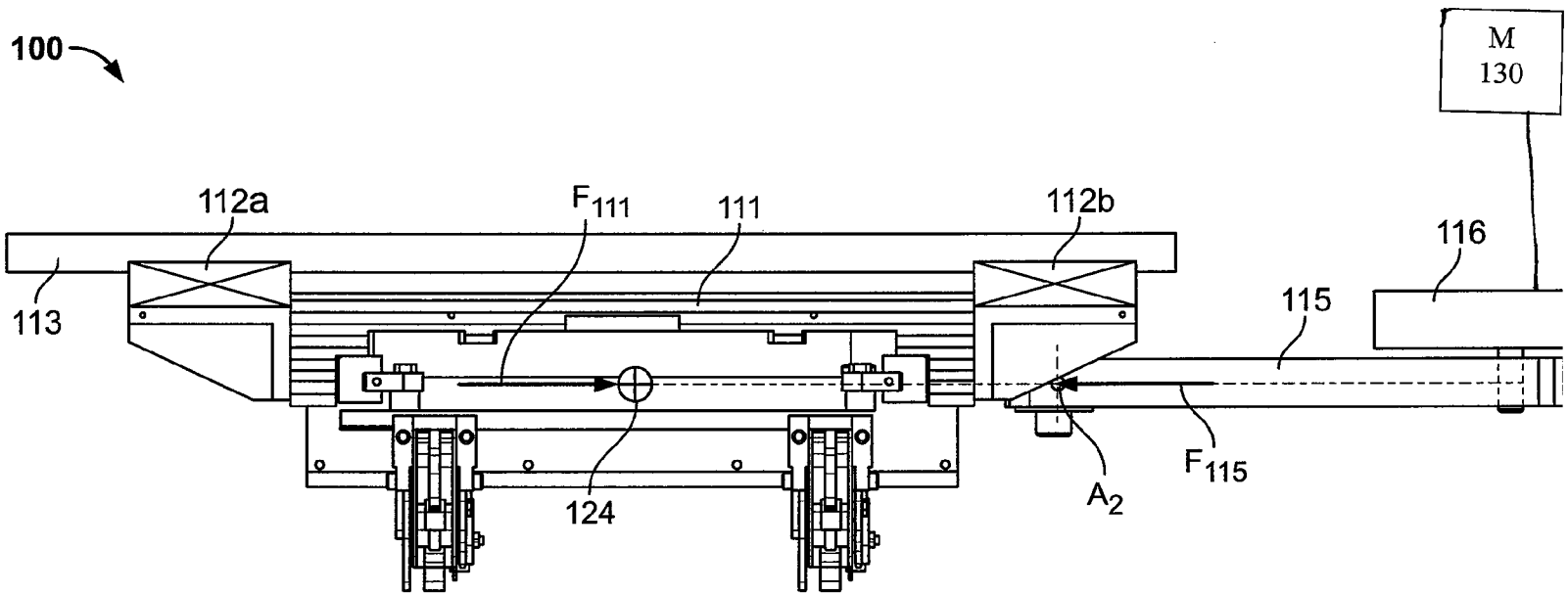

FIGS. 3A and 3B show a stitcher 100 in accordance with an embodiment of the present invention. A crank 116 drives an operating link 115 and rotates in a clockwise or counter-clockwise direction. Crank 116 is connected to a motor 130. In the position shown in FIG. 3A, link 115 is located in the three o'clock position with respect to crank 116. In this position, carriage 111 is closest to crank 116. When link 115 is at the nine o'clock position with respect to crank 116, the carriage 111 is furthest from crank 116. Operating link 115 is connected to carriage 111 at a pivot 114 and oscillates carriage 111 in a direction Y. A bearing rail 113 and linear ball bearings 112A, 112B support carriage 111. Operating link 115 is horizontal and parallel to the direction of oscillation when operating link 115 is at the nine o'clock and three o'clock positions with respect to crank 116. Pivot 114 of link 115 is located on a centerline 123 which runs through a center of gravity 124 of carriage 111. When link 115 is horizontal, for example in the nine o'clock or three o'clock positions, the inertial force $F_{111}$ of carriage 111 runs through operating link 115 and force $F_{115}$ is applied at a point $A_2$ along centerline

123. Thus, there is no lateral displacement between force $F_{115}$ applied at point $A_2$ and center of gravity 124. Consequently, none of the inertial force $F_{111}$ is transmitted to bearings 112A, 112B.

When operating link 115 is not in a horizontal position, for example, as crank 116 rotates between the three o'clock and nine o'clock positions, bearings 112A, 112B provide support for inertial force $F_{111}$ that develops due to the vertical displacement between $F_{115}$ and inertial force $F_{111}$ of carriage 111. The support in the bearings 112A, 112B is equal to the perpendicular distance from link 115 to center of gravity 124 and balances out the moment created.

FIG. 3B shows a top view of stitcher 100. The point $A_2$ of force $F_{115}$ of operating link 115 and inertial force $F_{111}$ of carriage 111 lie in the same vertical plane that goes through center of gravity 124. The positioning of inertial force $F_{111}$ and force $F_{115}$ in the same vertical plane reduces support loads in the linear bearings 112A, 112B. Thus, by moving the application point $A_2$ of the operating link force $F_{115}$ closer to center of gravity 24, forces in bearings 112A, 112B are reduced.

Figure 4:
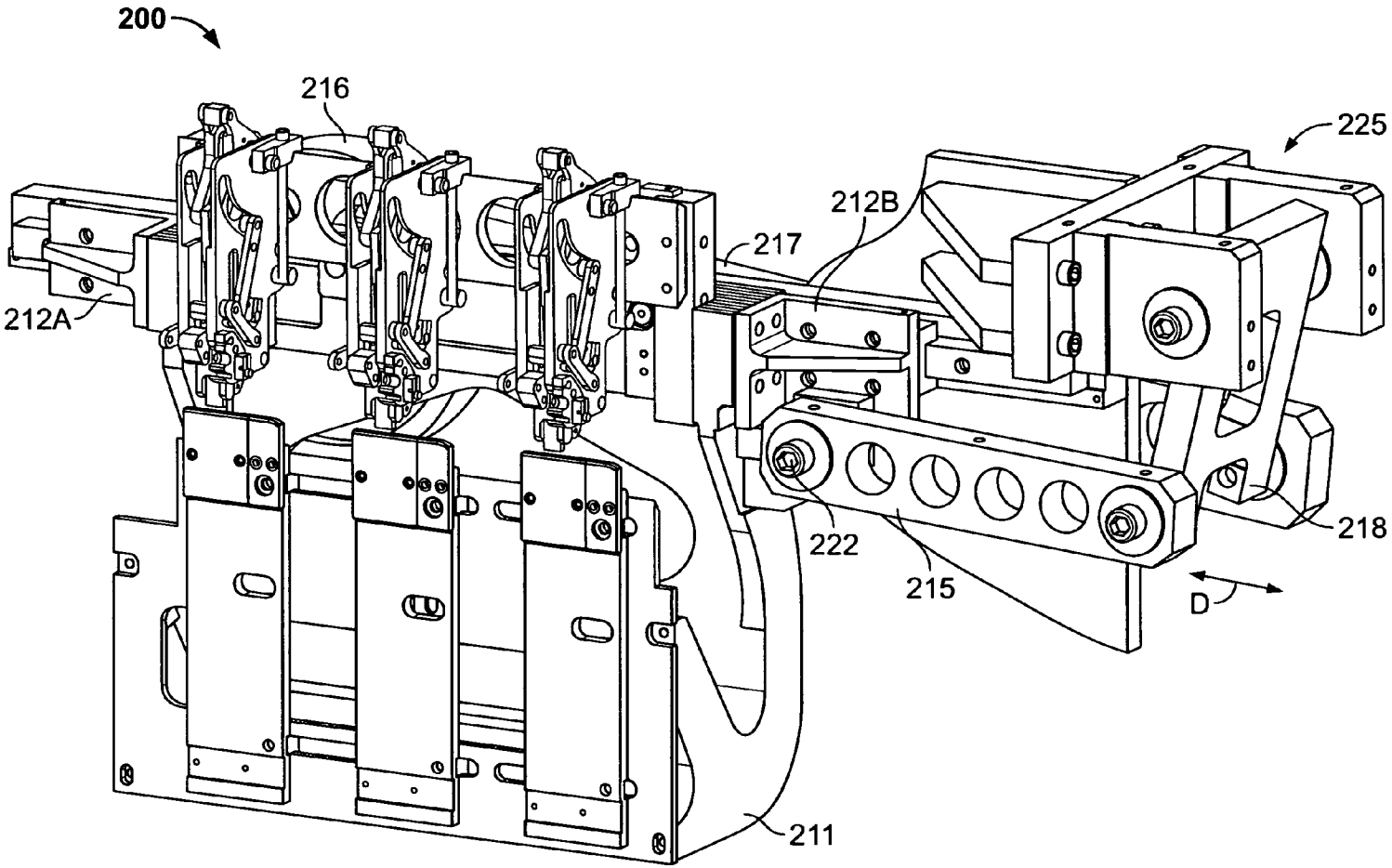
FIGS. 4, 5 and 6 show another preferred embodiment of a stitcher according to the present invention.
Figure 5:
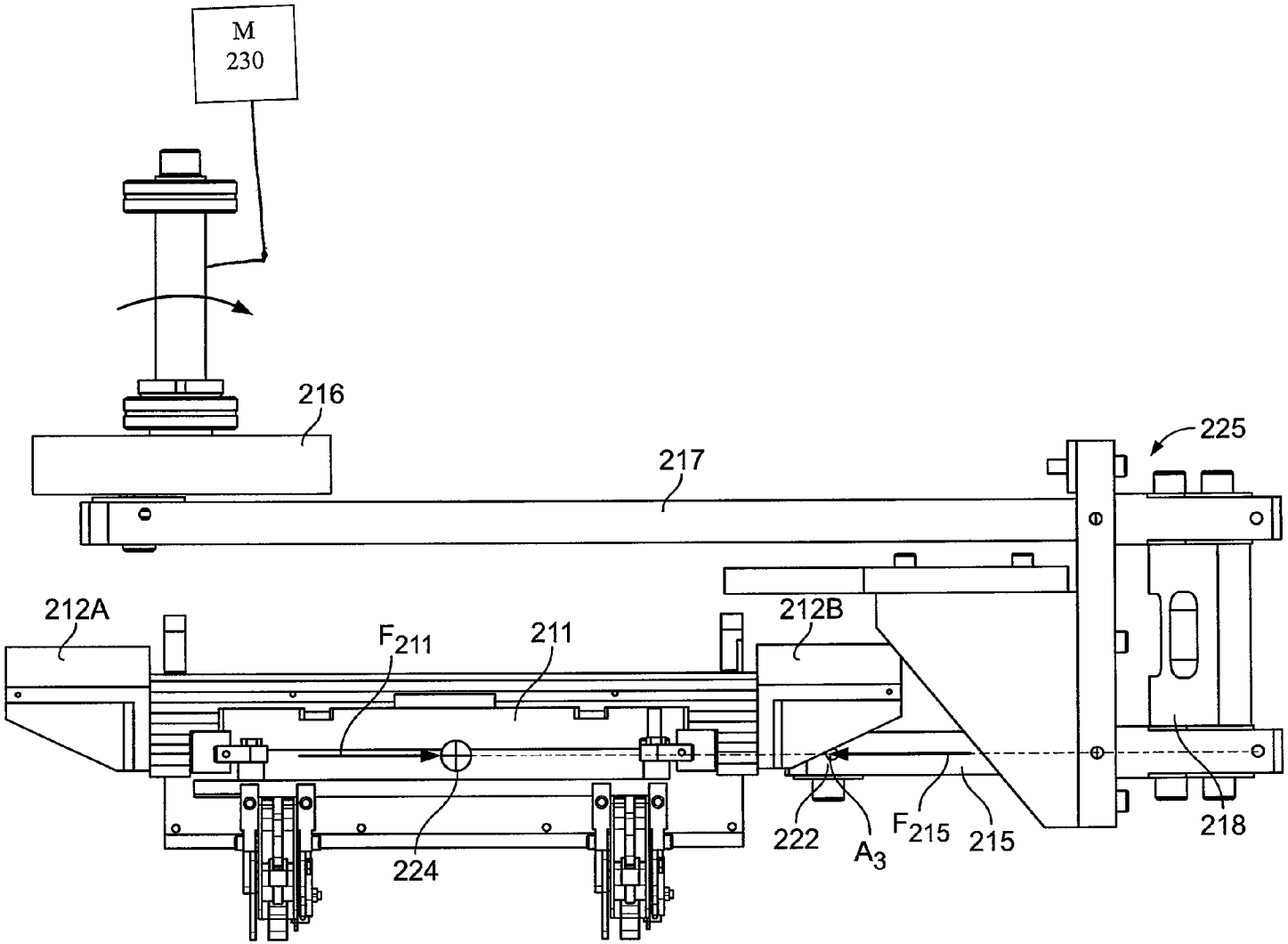

FIGS. 4 and 5 show another preferred embodiment according to the present invention. A stitcher 200 includes a carriage 211 mounted on linear ball bearings 212A, 212B. A crank 216 is connected to a link 217. Crank 216 is connected to a motor 230. A rocker arm 218 is movably mounted to a clevis 225 so rocker arm 218 can swing back and forth in a direction D. Rocker arm 218 is connected to an operating link 215 which is connected to carriage 211 at a pivot 222. When crank 216 is rotated, link 217 moves causing rocker arm 218 to move. Rocker arm 218 transmits the motion of link 217 to operating link 215. Operating link 215 subsequently moves carriage 211 via pivot 222 causing carriage 211 to oscillate.

As further shown in FIG. 5, the force $F_{215}$ of operating link 215 is applied at a point $A_3$ which lies in the same vertical plane as inertial force $F_{211}$ of carriage 211. The positioning of inertial force $F_{211}$, and force $F_{215}$ in the same vertical plane reduces support loads in the linear bearings 212A, 212B.

Figure 6A:
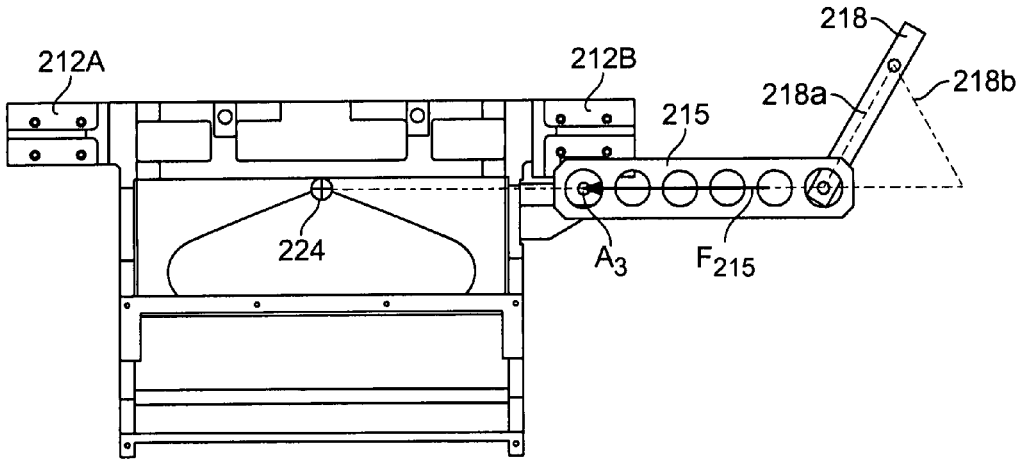
Figure 6B:
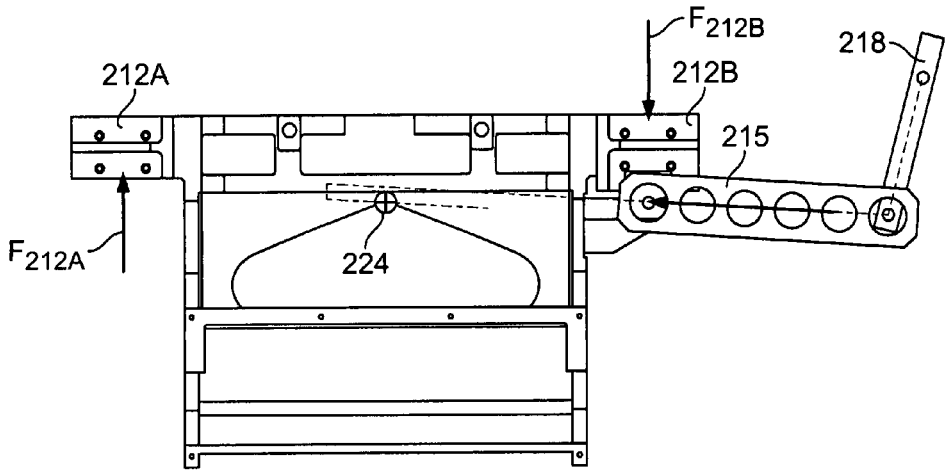

FIG. 6A shows rocker arm 218 in extended position 218*a* and the path for retracted position 218*b*. When rocker arm 218 is in extended position 218*a* or retracted position 218*b*, $F_{215}$ is applied at point A and moves through center of gravity 224. The perpendicular distance from point $A_3$ to center of gravity 224 is zero. Thus, inertial force $F_{211}$ is not transmitted to linear bearings 212A, 212B. When rocker arm 218 is any position between extended position 218*a* and retracted position 218*b* as shown in FIG. 6B, the force $F_{215}$ is applied close to center of gravity 224. The perpendicular distance from $F_{215}$ to center of gravity 224 is reduced resulting in reduced loads $F_{212A}$, $F_{212B}$ in linear bearings 212A, 212B. Thus, by applying an operating force $F_{215}$ between center of gravity 224 and bearings 212A, 212B, the support load in bearings 212A, 212B may be reduced.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A stitcher comprising:

a carriage having a center of gravity, the carriage movable between an extended position and a retracted position;

at least one bearing for supporting the carriage; and a drive including a crank, the crank connected to an operating link, the operating link connected to the carriage for imparting a driving force to the carriage;

the driving force of the operating link being applied through the center of gravity or between the center of gravity and the bearing.

2. The stitcher as recited in claim 1 wherein the at least one bearing includes two bearings.

3. The stitcher as recited in claim 2 wherein the bearings are connected to a bearing rail.

4. The stitcher as recited in claim 1 wherein the crank is connected to a drive motor.

5. The stitcher as recited in claim 1 further comprising a second link connected to a drive.

6. The stitcher as recited in claim 5 wherein the drive includes a crank.

7. The stitcher as recited in claim 6 wherein the crank is connected to a drive motor.

8. The stitcher as recited in claim 5 further comprising a rocker arm connecting the operating link to the second link.

9. The stitcher as recited in claim 8 wherein the rocker arm is rotatably connected to a clevis.

10. The stitcher as recited in claim 9 wherein the driving force is transferred from the second link to the operating link via the rocker arm and clevis.

11. The stitcher as recited in claim 1 wherein the driving force of the link is applied through the center of gravity when the carriage is in an extended or retracted position.

* * * * *